US005774147A

United States Patent [19]

Saito et al.

[11] Patent Number: 5,774,147

[45] Date of Patent: Jun. 30, 1998

[54] SUBSTRATE HAVING A COMMON COLLECTOR REGION AND BEING USABLE IN A LIQUID JET RECORDING HEAD

[75] Inventors: Asao Saito, Fujisawa; Tsutomu Kato; Ryoichi Koizumi, both of Atsugi, all of Japan

[73] Assignee: Canon Kabushiki Kaisha, Tokyo, Japan

[21] Appl. No.: 170,633

[22] Filed: Dec. 21, 1993

Related U.S. Application Data

[63] Continuation of Ser. No. 754,188, Aug. 28, 1991, abandoned, which is a continuation of Ser. No. 625,704, Dec. 11, 1990, abandoned, which is a continuation of Ser. No. 385,071, Jul. 25, 1989, abandoned.

[30] Foreign Application Priority Data

Jul. 26, 1988 [JP] Japan ..... 63-184696

[51] Int. Cl.[6] ..... B41J 2/05

[52] U.S. Cl. ..... 347/59

[58] Field of Search ..... 347/59, 58, 57, 347/12, 13, 211, 210

[56] References Cited

U.S. PATENT DOCUMENTS

| | | | |
|---|---|---|---|
| 3,617,823 | 11/1971 | Hofstein . | |
| 3,725,881 | 4/1973 | Dellor . | |
| 3,877,059 | 4/1975 | Dockendorf . | |
| 4,078,243 | 3/1978 | DeBar . | |
| 4,176,272 | 11/1979 | Powers | 347/210 |
| 4,204,130 | 5/1980 | Harris | 357/46 X |
| 4,262,188 | 4/1981 | Beach | 347/194 |
| 4,394,669 | 7/1983 | Ozawa | 347/30 X |
| 4,403,233 | 9/1983 | Terasawa | 347/30 |
| 4,429,321 | 1/1984 | Matsumoto | 347/59 |
| 4,441,167 | 4/1984 | Principi . | |
| 4,520,373 | 5/1985 | Ayata | 347/13 |

FOREIGN PATENT DOCUMENTS 14969 1/1984 Japan .

OTHER PUBLICATIONS

Delhom, Louis A.; Design and Application of Transistor Switching Circuits; 1968, McGraw–Hill Book Co.; pp. 56,57,137,138.

*Primary Examiner*—Joseph W. Hartary
*Attorney, Agent, or Firm*—Fitzpatrick, Cella, Harper & Scinto

[57] ABSTRACT

A substrate usable for a liquid jet recording head having a semiconductor substrate, transistors, and electricity-heat converting elements for generating heat energy to be utilized for discharging a liquid, which is electrically connected to said transistors, in which a plurality of said transistors is provided and the collector region of said transistors is made common.

49 Claims, 9 Drawing Sheets

SUBSTRATE HAVING A COMMON COLLECTOR REGION AND BEING USABLE IN A LIQUID JET RECORDING HEAD

This application is a continuation of application Ser. No. 07/754,188 filed Aug. 28, 1991, now abandoned and which was a continuation of Ser. No. 07/625,704 filed Dec. 11, 1990, now abandoned which in turn was a continuation of application Ser. No. 07/385,071, filed Jul. 25, 1989, now abandoned.

BACKGROUND OF THE INVENTION

1. Field of the Invention

This invention relates to a substrate usable for a liquid jet recording head having an electricity heat-converting element and a transistor array as the functional element for driving the converting element formed on the same substrate, a liquid jet recording head having said substrate, and recording equipment having said head.

2. Related Background Art

In the liquid jet recording method for recording discharging liquid, there have been known many principles for discharging liquid. And there have been known various types of liquid jet recording heads and recording equipments utilizing the methods.

Among them, the method of discharging a liquid by utilizing heat energy generated by electricity-heat converting elements has been watched since the method is suitable for miniaturization, high precision and elongation.

For a liquid jet recording head employing discharging method utilizing such heat energy, for example, there has been known a liquid jet recording head having an array of electricity-heat converting elements on a silicon substrate, arranging a functional element for driving converting elements such as a transistor array externally of the silicon substrate as the driving circuit for the electricity-heat converting elements, and effecting connection between the electricity-heat converting elements and the transistor array by flexible cable or wire bonding, etc.

For the purpose of simplifying the structure of the head described above, reducing defects occurring in the preparation steps, and further improving uniformization and reproducibility of the characteristics of the respective elements, there has been proposed a liquid jet recording device having an electricity-heat converting element and a functional element provided on one and the same substrate in U.S. Pat. No. 4,429,321.

However, for realizing the structure as described above, about 10 to 12 steps are required only for the transistor portion as the functional element in practice, and such an enormous number of steps increases probability generating factors incurring reduction in yield. That is, although defects are reduced as an advantage by providing the electricity-heat converting element and the functional element on one and the same substrate, the yield of the functional element is lowered as the preparation steps of the functional element are more complicated, consequently posing a problem that the yield in the steps of the liquid jet recording head as a whole is lowered.

For solving such a problem, first it is required to improve the step yield of the functional element, and for that purpose, the step precision must be improved, which will incur increase in head production cost leading to an increase in production cost.

In the present invention, a transistor array is formed with a reduced number of steps for providing a common collector region for the transistor array, thus reducing the cost of manufacturing the substrate and for example, a recording head which uses such a substrate.

SUMMARY OF THE INVENTION

It is an object of the present invention to solve the above-mentioned problems which occur particularly in a substrate usable for the liquid jet recording head employing the process of discharging a liquid by utilizing heat energy, a liquid jet recording head having said substrate, and a recording equipment having said recording head.

Another object of the present invention is to provide a substrate usable for the liquid jet recording head capable of recording a higher quality and higher grade, a liquid jet recording head having said substrate, and recording equipment having said recording head.

Still another object of the present invention is to provide a substrate usable for the liquid jet recording head, which is produced at a low cost and has high performance, a liquid jet recording head having said substrate, and recording equipment having said recording head.

A further object of the present invention is to provide, by calling attention to the fact that the collector potentials may be the same, a substrate usable for the liquid jet recording head, which realizes with reduced preparation steps to enable improvement in yield. The substrate also enables lower in production costs by reducing the number of the steps, by forming a transistor constitution common to collectors and omitting the need for separating the transistor actuation such as isolation layer. The substrate can be used in a liquid jet recording head, and recording equipment having said recording head.

A further object of the present invention is to provide a liquid jet recording head having a discharging opening for discharging a liquid, and an electricity-heat converting element provided near said discharging opening. The recording wherein said head has a transistor array comprising a plurality of transistor cells arranged thereon which are provided for driving said electricity-heat converting element independently and formed on one and the same substrate as said electricity-heat converting element, and the collector region in each of said transistor cells is made common in said transistor array. More preferably the present invention provides, a liquid jet recording head in which the collector electrode pattern in each of the transistor cells is made common in the transistor array.

According to one aspect of the present invention, there is provided a substrate usable for a liquid jet recording head having a semiconductor substrate, transistors, and electricity-heat converting elements for generating heat energy to be utilized for discharging a liquid, which is electrically connected to said transistors, in which a plurality of said transistors are provided at a common collector region of said transistors.

According to another aspect of the present invention, there is provided a liquid jet recording head having a discharging opening for discharging a liquid, an electricity-heat converting element provided near said discharging opening for generating heat energy to be utilized for discharging said liquid, and a transistor formed on a semiconductor substrate electrically connected to said electricity-heat converting element, in which a plurality of said transistors are provided at a common collector region of said transistors.

According to a further object of the present invention, there is provided a recording head comprising a liquid jet recording head having a discharging opening for discharging a liquid, an electricity-heat converting element provided near said discharging opening for generating heat energy to be utilized for discharging said liquid, and a transistor formed on a semiconductor substrate electrically connected to said electricity-heat converting element, an ink tank straging said liquid to be supplied to said liquid jet recording head, and a platen for a recording medium accepting the liquid discharged from said liquid jet recording head 1, in which the collector region of said transistors is made common to a plurality of transistors.

According to a still further object of the present invention, there is provided a liquid jet recording head having a discharging opening for discharging a liquid, a liquid channel in communication with said discharging opening and an electricity-heat converting element corresponding to said discharging opening, wherein said head has a transistor array comprising a plurality of transistor cells arranged thereon which are provided for driving said electricity-heat converting element independently and formed on one and the same substrate as that for said electricity-heat converting element, and the collector region in each of said transistor cells is made common in said transistor array.

According to another object of the present invention, there is provided a substrate for liquid jet recording head having an electricity-heat converting element for generating discharging energy for discharging a liquid, wherein said substrate has a transistor array comprising a plurality of transistor cells arranged thereon which are provided for driving said electricity-heat converting element independently and formed on one and the same substrate as that for said electricity-heat converting element, and the collector region in each of said transistor cells is made common in said transistor array.

DESCRIPTION OF THE PREFERRED EMBODIMENTS

Figure 1A:
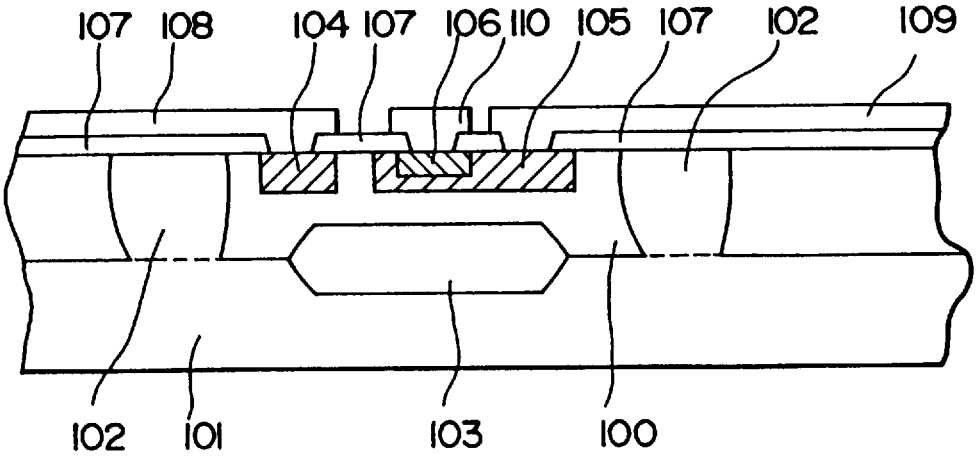
FIGS. 1A and 1B are respectively a schematic sectional view and a schematic top view showing the transistor cell capable of being used in the liquid jet recording head.

Referring now to the drawings, the present invention is to be described.

Figure 1B:
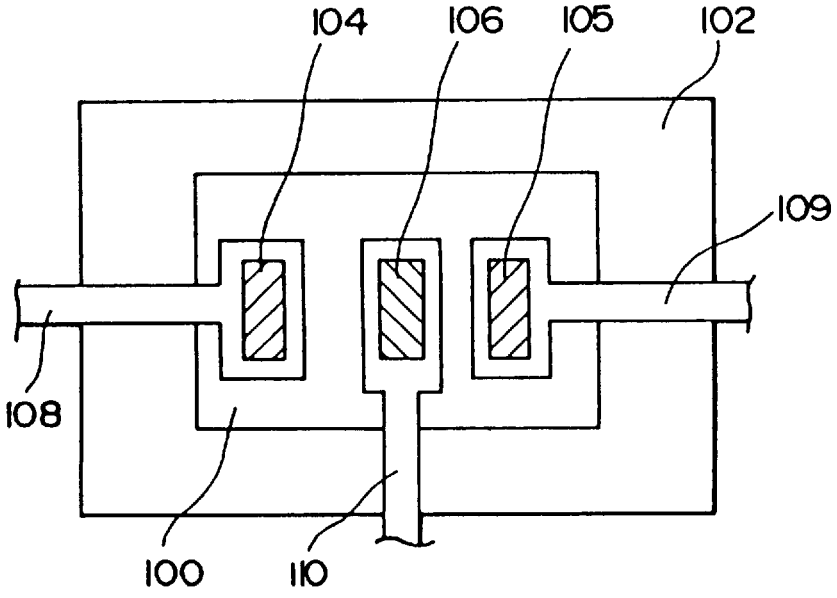

FIGS. 1A and 1B are respectively a sectional view and a top view showing an example of a NPN transistor as the functional element to be used in combination with an electricity-heat converting element of a liquid jet recording head.

As shown in these Figures, an N-type epitaxial layer 100 is grown on a P-type silicon substrate 101, and a $p^+$ layer for base 105, an $n^+$ layer for collector 104 and an $n^{30}$ layer for emitter 106 are doped thereinto, and further an insulating layer 107 is formed on the epitaxial layer 100. On the upper surface of the insulating layer 107 are formed a base electrode 109, a collector electrode 108 and an emitter electrode 110. In the same Figures, 102 is an isolation layer, which separates electrically the transistor cell formed as described above from other cells. 103 is an embedding layer as the current channel with small resistance.

Figure 2:
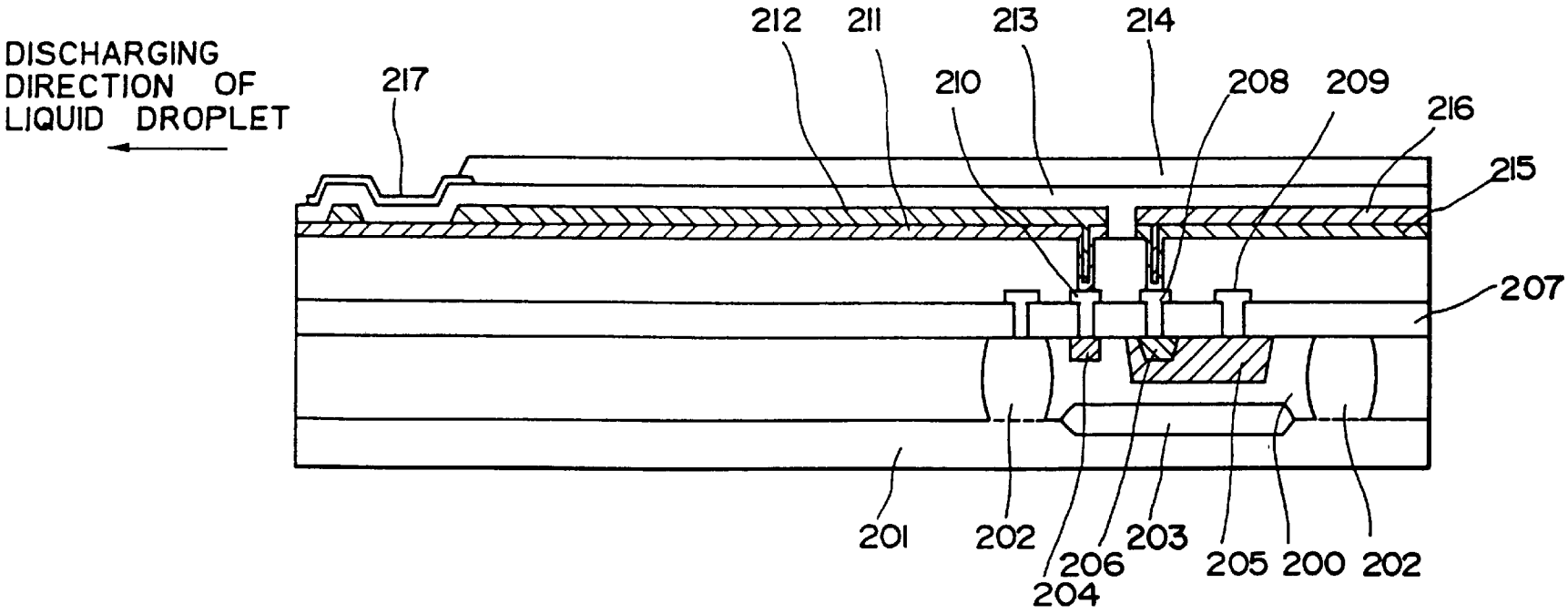
FIG. 2 is a schematic sectional view showing an example of the transistor cell formed at a silicon substrate and the electricity-heat converting element provided on the substrate.

FIG. 2 shows a schematic longitudinal sectional view of a substrate portion of a liquid jet recording head having the transistor of the structure as described above on the substrate to be provided with electricity-heat converting elements. As shown in the same Figure, first, for constitution of the transistor as described above, an N-type epitaxial layer 200 is grown on a P-type silicon substrate 201, and a $p^+$ layer for base 205, an $n^+$ layer for collector 204 and an $n^+$ layer for emitter 206 are doped thereinto. Into the epitaxial layer 200 is doped a $p^+$ layer 202 as the isolation layer for separating the transistor actuation from others. Also, an embedding layer 203 as the current channel is doped.

The emitter electrode 210 is connected to a resistor wiring 211 formed of $HfB_2$, for example, and an aluminum wiring 212, and the electricity-heat converting element is constituted of both of these. The collector electrode 208 is taken out externally through the resistor wiring 215 and the aluminum wiring 216 constituting the driving current supplying terminals. Further, to the base electrode are added externally driving timing control signals for the electricity-heat converting element.

Also, on the upper part of the electricity-heat converting element are laminated protective films 213, 214 and 217 formed of, for example, $SiO_2$, Ta, organic resin films, etc. for the purpose of protecting resistor aluminum wiring from ink, etc. At the upper part of the protective film 217 is formed a bubble formation chamber, and hence a heat-generating resistance portion beneath the film 217.

Whereas, in case of producing the substrate having such construction, many producing processes are needed and therefore possibility of occurring such problems as described above is high. Thus, according to the present invention, the above problems are solved by the constitution capable of further lowering the number of producing process.

Referring now to the drawings, examples of the present invention are to be described in detail.

Figure 3:
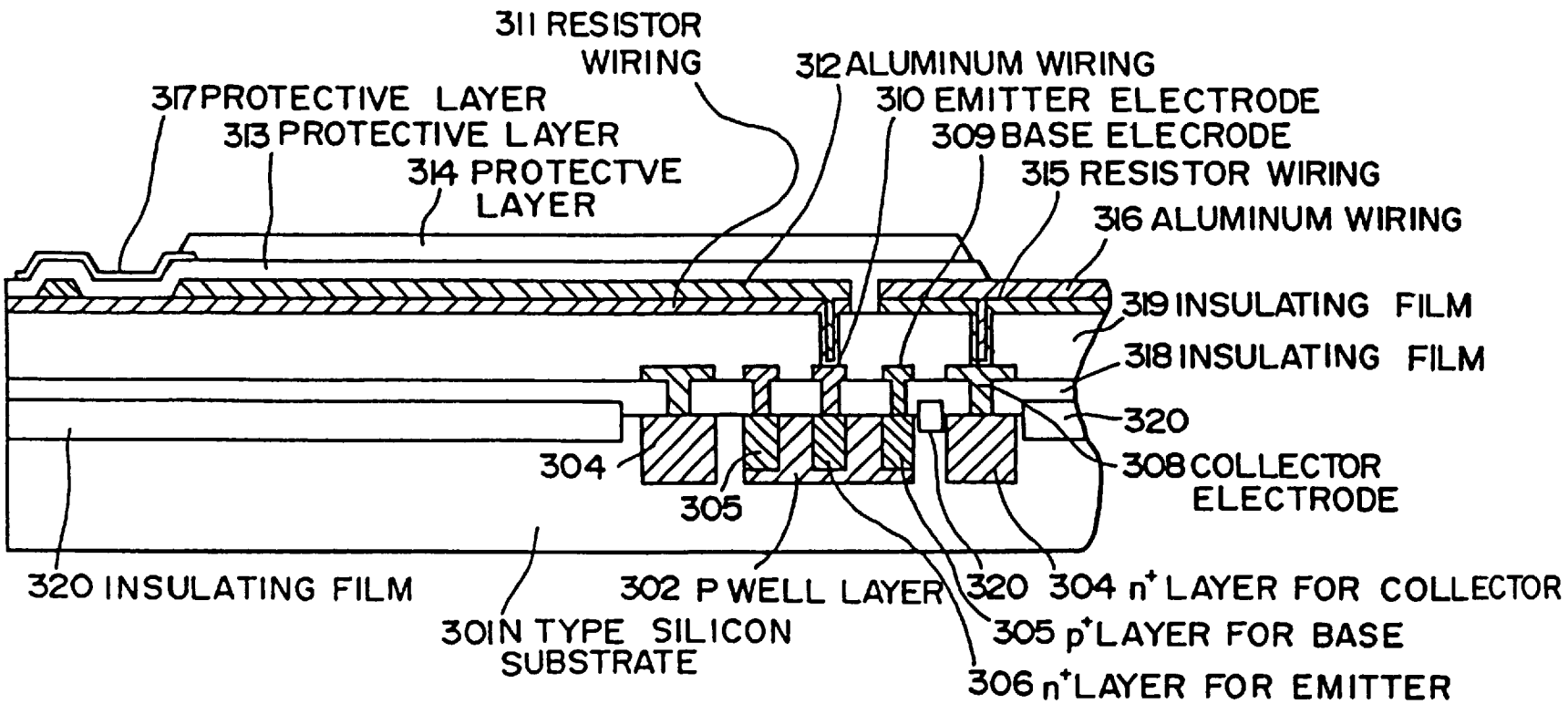
FIG. 3 is a schematic sectional view showing the transistor cell and the electricity-heat converting element according to a preferred example of the present invention.

FIG. 3 is a schematic longitudinal sectional view of the substrate portion of the liquid jet recording head showing a preferred example of the present invention.

In the same Figure are shown only one transistor cell of the transistor array as the functional element and the electricity-heat converting element corresponding thereto. In the Figure, in the N type silicon substrate 301 is doped a P well diffusing layer 302. On the P well layer 302 are doped a $p^+$ layer for base 305 and an $n^+$ layer for emitter 306. Also, adjacent to the P well layer 302 is doped an $n^+$ layer for collector 304 which is common to the respective transistors.

Insulating films 318, 319 and 320 on the transistor structure are formed. The insulating films 318 and-319 impart the effects of insulation from the upper wiring and heat accumulation at the lower surface of the electricity-heat converting element as a heat barrier layer for acting efficiently generated heat energy on liquid (ink) and eliminating quickly excess heat not to be used for ejecting. The electricity-heat converting element has a resistor wiring 311 formed of $HfB_2$, for example, an aluminum wiring 312 and protective films 313, 314 and 317 of $SiO_2$, Ta, organic resin film, for example, formed on the upper surfaces of these, and is connected to the emitter electrode 310 of the above transistor. At the tip end side of the electricity-heat converting element, namely at the lower part of the protective film 317 is formed a heat-generating portion. When the recording head is completed bubbles are formed at the upper part of the protective film 317. The collector electrode 308 is taken out externally through the resistor wiring 315 as the common electrode and the aluminum wiring 316 to become a recording head driving current supplying electrode. Further, driving control signals for turning on or off the actuation of the transistor are supplied to the base electrode 309 through the wiring not shown.

Figure 4:
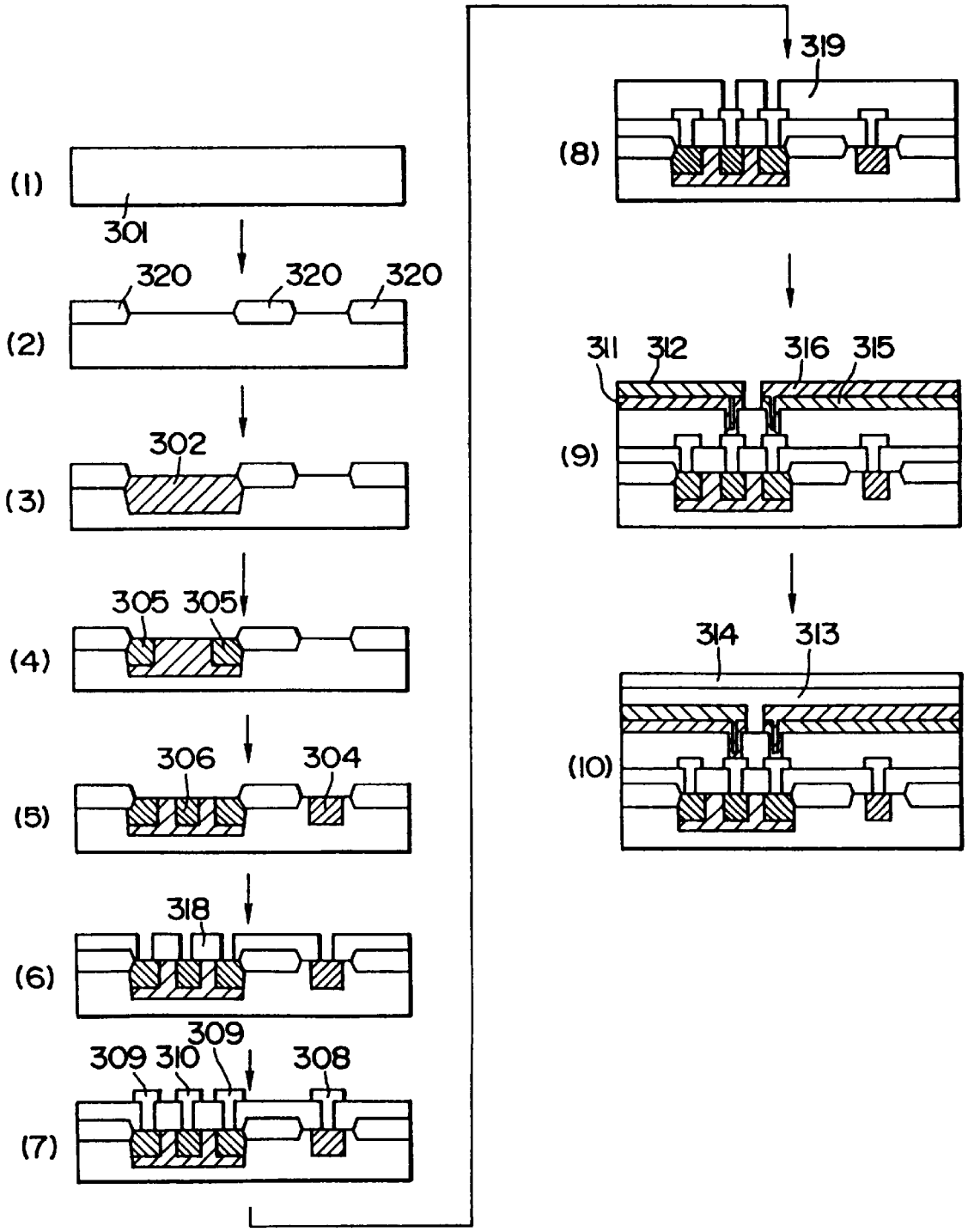
FIG. 4 is a schematic sectional view of the preparation steps of the schematic view in FIG. 3.

FIG. 4 shows an example of schematic steps for forming the functional element of the substrate for the liquid jet recording head as described above at an N type silicon substrate 301. However, in the Figure, the tip end side in the discharging direction is omitted.

Referring now to the step diagram in FIG. 4, the procedure of formation of the functional element (a transistor here) is to be described briefly.

In step (2), a $SiO_2$ insulating layer 320 is pattern-formed by use of a photoresist on the N type silicon substrate 301. Next, in step (3), a P well diffused layer 302 is doped by diffusion of controlling material of electric conductive type (hereinafter impurity) into the silicon substrate 301 to be formed P type region. In the steps (4) and (5), in order to form $p^+$ layer 305 and $n^+$ layer 306, the electric conductive type impurity further doped into the P well layer 302. Also, at the same time, $n^+$ layer for collector 304 common to the respective transistors is formed adjacent to the P well layer 302 by doping the impurity.

Next, in the steps (6)(7) and an $SiO_2$ layer for insulation 318 is pattern-formed on the semiconductor structure, followed further by providing with the respective electrodes 309, 308 and 310 for base, collector and emitter. Further, in step (8), a required portion of $SiO_2$ film 319 is covered for the purpose of insulation and heat accumulation. Next, in the steps (9) and (10), resistor layers 311, 315 and aluminum wirings 312, 316 for constituting the electricity-heat converting element are patterned, and their upper layers are covered with protective layers 313, 314 of $SiO_2$, or organic resin, for example.

Figure 5A:
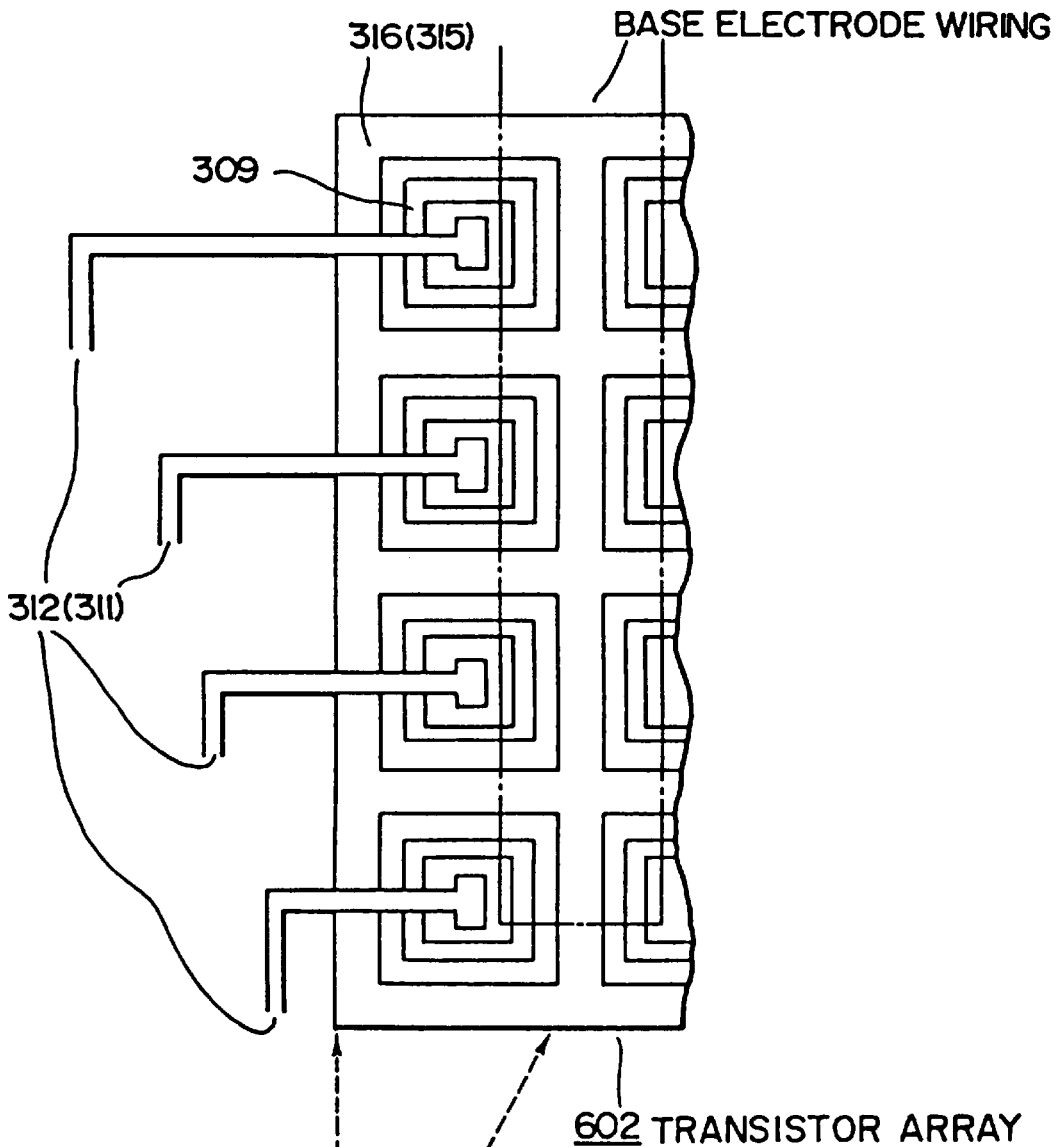
FIG. 5 and FIG. 6 are respectively a schematic top view and a schematic sectional view of the transistor array of the transistor cell shown in FIG. 3.
Figure 5B:
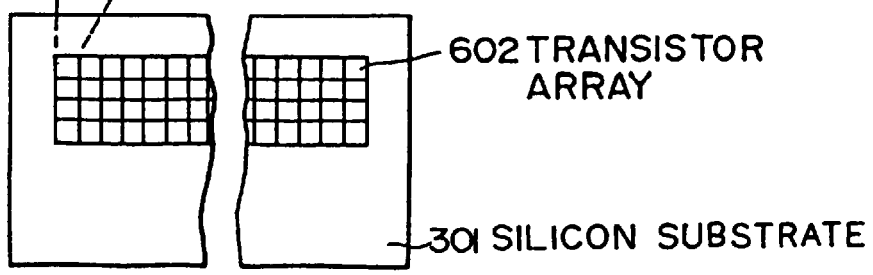
Figure 6:
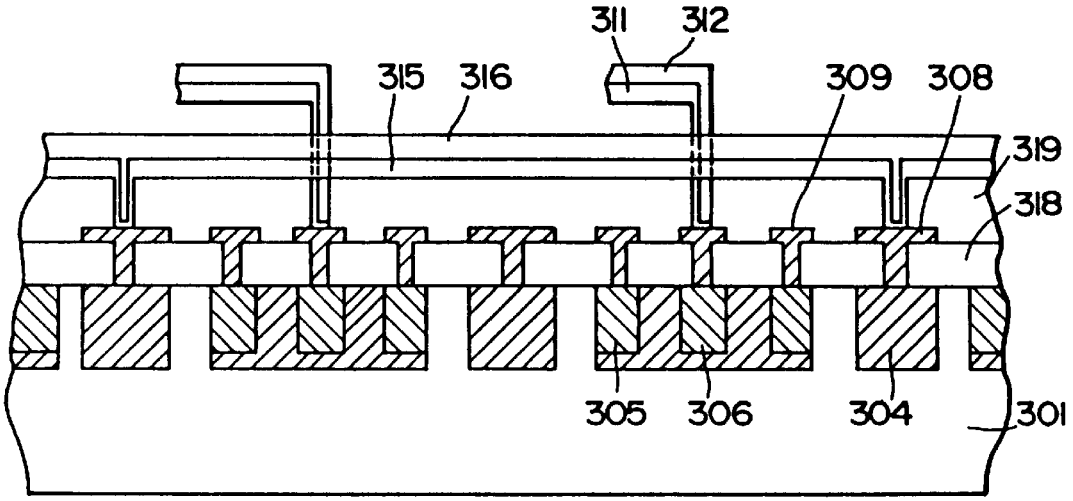

FIG. 5 and FIG. 6 show a transistor array constituted of the transistor cell shown in FIG. 3 arranged, with FIG. 5 being a top view of the transistor array, and FIG. 6 a schematic partial cross sectional view as seen from the direction of an arrow A in FIG. 5.

As can be seen from these Figures, particularly FIG. 6, the aluminum wiring 316 (resistor wiring 315) connected to the collector electrode 308 is patterned as the wiring common to the respective transistor cells, and also $n^+$ layer for collector is formed in the same pattern beneath the aluminum wiring 316 by doping the impurity although not shown in the Figure.

As is apparent from the above described, in forming a transistor array 602 and an electricity-heat converting element at a silicon substrate 301, no isolation layer for separating the transistor actuation from others is required, and therefore doping pattern and the electrode pattern on the substrate 301 can be simplified to reduce the number of steps for forming the recording head.

Figure 7:
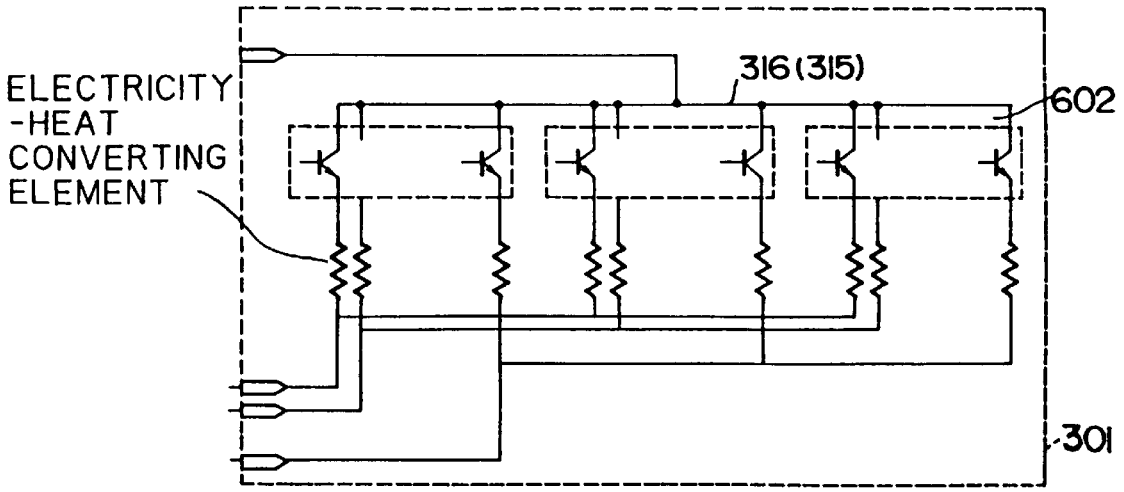
FIG. 7 is an equivalent circuit diagram of the schematic views shown in FIG. 5 and FIG. 6.

FIG. 7 is an equivalent circuit diagram of the liquid jet recording head constituted of the transistor array and the electricity-heat converting element shown in FIG. 5 and FIG. 6.

Figure 8:
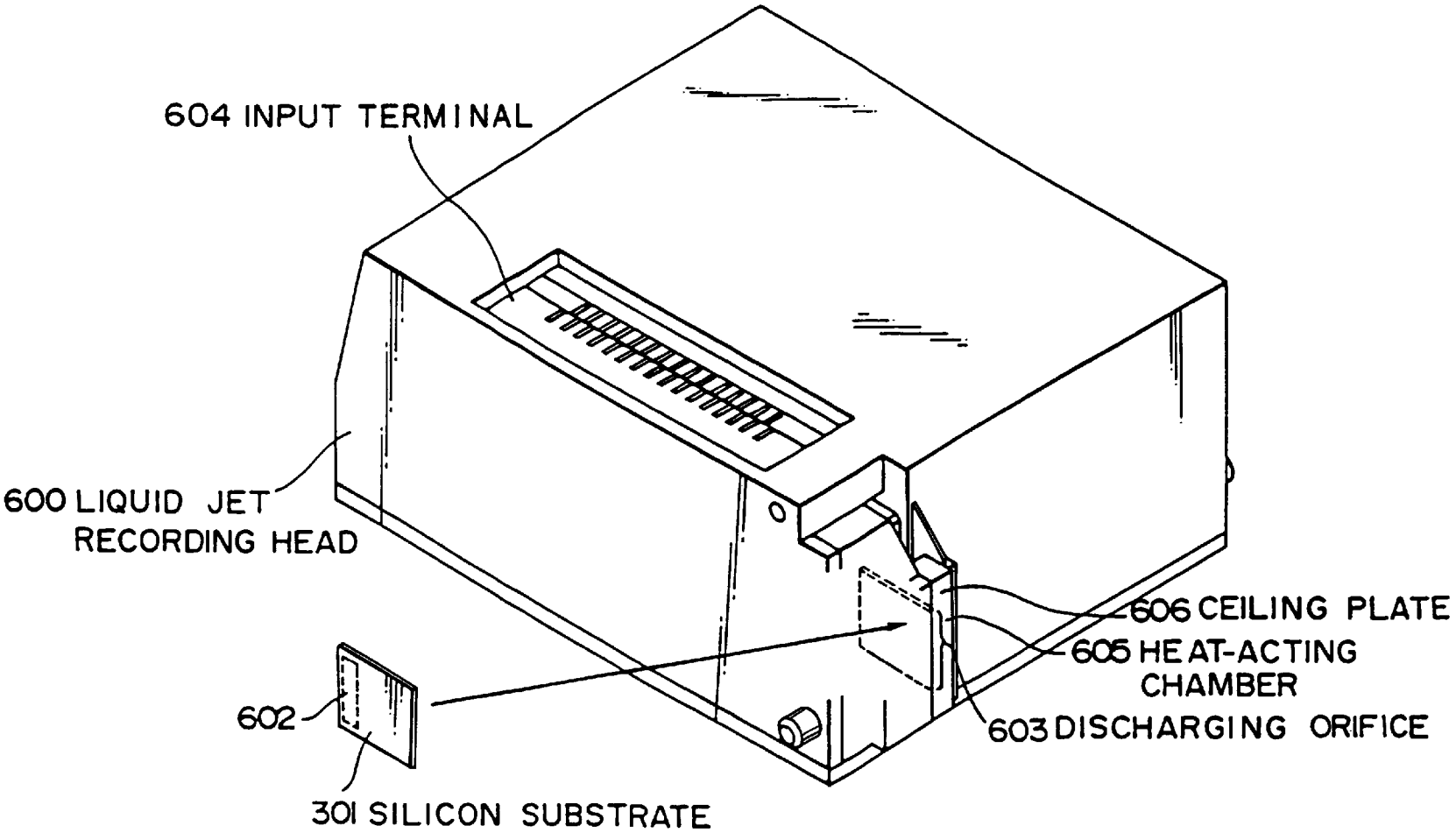
FIG. 8 is a schematic perspective view of a liquid jet recording head having the substrate with the constitution and the electricity-heat converting element shown in FIG. 5 and FIG. 6 practicably mounted thereon.

FIG. 8 is a perspective view of a liquid jet recording head having practicably mounted the silicon substrate shown in FIG. 5. This Figure shows a recording head in the serial type recording device, and the upper surface shown in the Figure becomes the bonding face with the carriage. As can be understood from the Figure, a heat-acting chamber 605 and a discharging orifice 603 are constituted by arrangement of a ceiling plate 606 and a silicon substrate 301 at the tip end of the recording head 600.

In the transistor structure shown in the above example, the constitution having the $n^+$ layer for collector 304 arranged so as to surround the P well layer 302 can inhibit current loss at the collector electrode, and also can inhibit fluctuation in loss rate by fluctuation of the steps.

As the result, loss of the current supplied to the liquid jet recording device can be prevented, thereby enabling improvement of recording quality, such as reduction in recording density irregularity.

Figure 9:
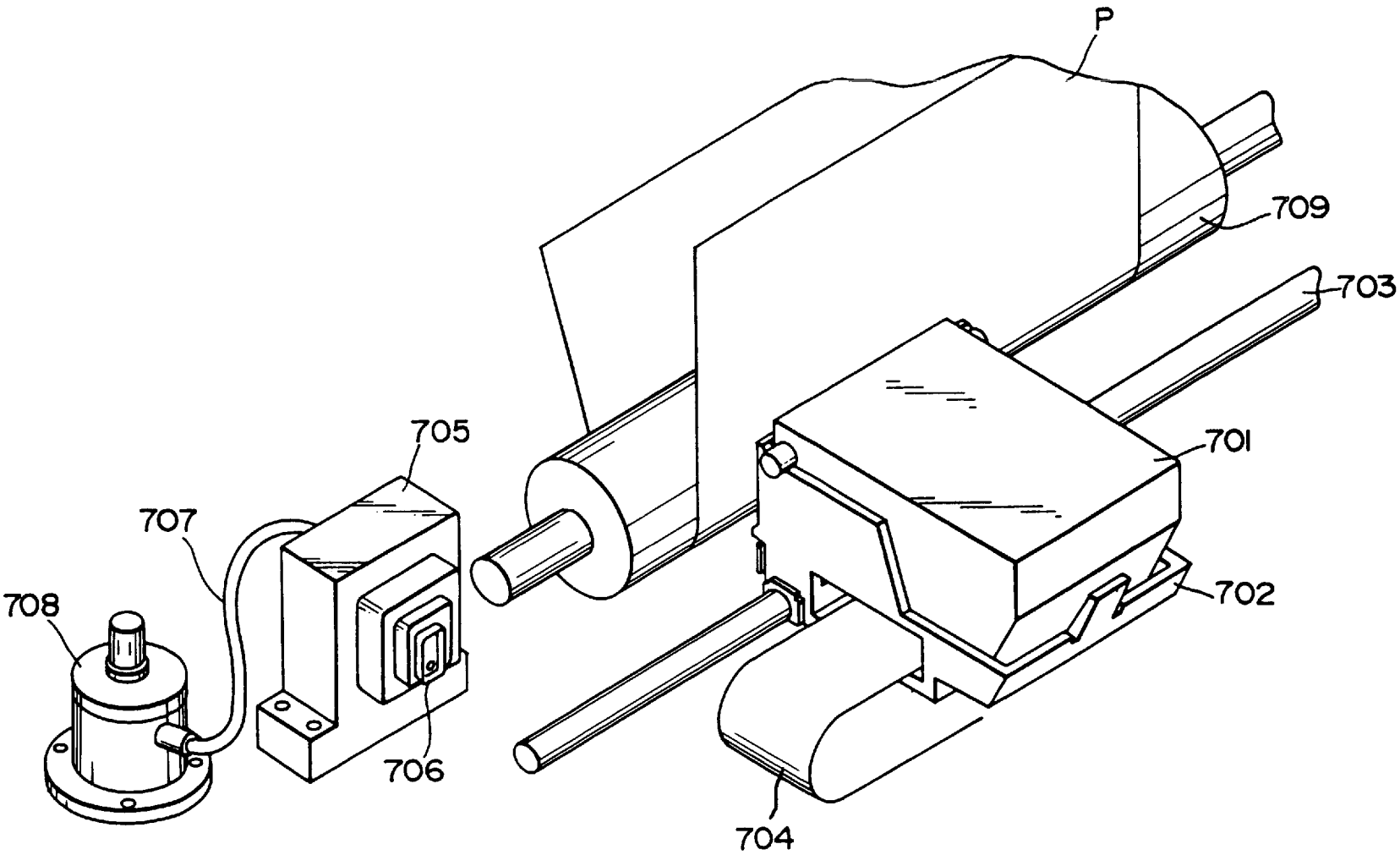
FIG. 9 is a schematic perspective view showing a principal portion of a recording apparatus mounted on a head cartridge having a recording head shown in FIG. 8.

Referring FIG. 9, equipment having the above-mentioned liquid jet recording head is illustrated as one suitable example.

In FIG. 9, 701 is a head cartridge, 702 a carriage, 103 a rail, 104 a flexible wiring plate, 705 a capping equipment, 706 a cap, 707 a suction tube, 708 a suction pump, 709 a platen and P a recording paper.

The head cartridge 101 is loaded on the carriage 702. Thus the electric connection and the location are effected. The carriage 702 is controlled along the rail 703 and goes and returns with a driving means not shown in the figure. The flexible wiring plate transmits the driving signal from the equipment body to an electric contact point not shown in the figure of the carriage 702.

The capping means 705 has the cap 706. The capping means is constructed so that the cap 706 covers the discharging opening of the head cartridge when the head cartridge comes to the capping position by movement of the carriage 702. When the suction pump 708 is driven at this state (capping state), the ink is sucked from the discharging opening of the head cartridge through the suction tube 707 to restore and/or keep the function of the head cartridge.

As shown in FIGS. 8 and 9, the equipment may be made in the form in which the recording head is fixed to the carriage 702 without an ink tank and the ink is supplied from an ink tank loaded on the equipment body by use of the ink-supplying tube. Many variations can be performed within the scope of the present invention.

The capping equipment is illustrated about the suction mechanism in the above description. However, the construction of the capping equipment is not limited to the above-mentioned construction provided that the function of the head is maintained, and that the function of restoration of poor discharging etc. can be effected. In some case, it is possible that the recording equipment has no capping equipment. However, it is desirable that the recording equipment has the capping equipment in order to perform recording more certainly.

As is apparent from the above description, according to the present invention, the constitution of the transistor cell, and hence the constitution of the transistor array can be simplified.

As the result, the steps of preparing a liquid jet recording head can be shortened and it has become possible to improve the yield in product and to lower cost.

Figure 10:
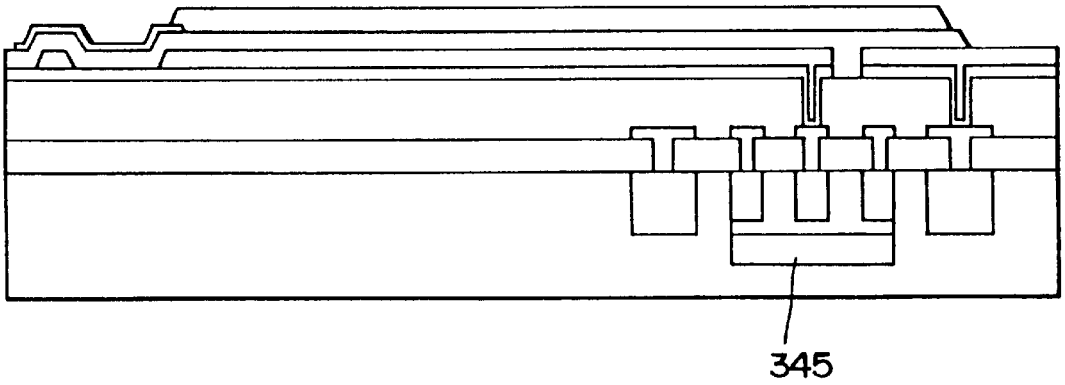
FIG. 10 is a sectional view showing another preferred example of the transistor cell.

FIG. 10 shows a constitution enabling reduction in current loss by parasitic resistance by providing an NBL layer 345 beneath the transistor structure for preventing collector loss as described above.

Having described about an example of forming an NPN transistor on an N type silicon substrate in this example, the present invention is also applicable to the case of forming a PNP transistor on a P type silicon substrate as a matter of course.

We claim:

1. In a substrate for a liquid jet recording head:

electricity-heat converting elements for generating heat energy for discharging a liquid; and a plurality of transistors for individually driving said electricity-heat converting elements, each of said plurality of transistors being electrically connected to a corresponding one of said electricity-heat converting elements, wherein each of said plurality of transistors includes a base region, an emitter region and a collector region, each emitter region being electrically connected to a corresponding one of said electricity-heat converting elements, and wherein the collector region is provided in common to each of said plurality of transistors and surrounds the base region and emitter region of each transistor, the collector regions, the base regions and the emitter regions comprising a semiconductor.

2. A substrate according to claim 1, wherein each electricity-heat converting elements compress a heat-generating resistor layer and an electrode.

3. A substrate according to claim 1, further comprising a plurality of transistor groups, each transistor group including at least one of said plurality of transistors and each transistor group being provided with a common collector region.

4. A liquid jet recording head comprising:

a head formed with discharge openings for discharging a liquid; and a substrate within said head and including a plurality of electricity-heat converting elements for generating heat energy for discharging the liquid through the openings and further including a plurality of transistors for individually driving the electricity-heat converting elements, each of the plurality of transistors being electrically connected to a corresponding one of said electricity-heat converting elements, each of the plurality of transistors including a base region, an emitter region and a collector region, each emitter region being electrically connected to a corresponding one of said electricity-heat converting elements, and the collector regions being provided in common to each of the plurality of transistors and surrounding the base region and the emitter region of each transistor, the collector regions, the base regions and the emitter regions comprising a semiconductor.

5. A liquid jet recording head according to claim 4, wherein said electricity-heat converting elements are formed on said semiconductor substrate.

6. A liquid jet recording head according to claim 4, wherein each electricity-heat converting element comprises a heat-generating resistor layer and an electrode.

7. A liquid jet recording head according to claim 4, wherein said semiconductor substrate further comprises a plurality of transistor groups, each transistor group including at least one of said plurality of transistors and each transistor group being provided with a common collector region.

8. A recording apparatus comprising:

a liquid jet recording head having discharge openings for discharging a liquid and having a substrate which includes electricity-heat converting elements for generating heat energy for discharging the liquid through the discharge openings and further including a plurality of transistors for individually driving the electricity-heat converting elements, each of the plurality of transistors being electrically connected to a corresponding one of said electricity-heat converting elements, each of the plurality of transistors including a base region, an emitter region and a collector region, each emitter region being electrically connected to a corresponding one of said electricity-heat converting elements, and the collector-region being provided in common to the plurality of transistors and surrounds the base region and wherein the collector region the emitter region of each transistor, the collector regions, the base regions and the emitter regions comprising a semiconductor; and means for supplying driving signals to the transistors in said liquid jet recording head for discharging the liquid.

9. The recording apparatus according to claim 8, further comprising a capping means for capping said discharge openings.

10. The recording apparatus according to claim 8, further comprising a suction pump for sucking the liquid within said recording head through said discharge openings.

11. A recording apparatus according to claim 8, wherein said electricity-heat converting elements are formed on said semiconductor substrate.

12. A recording apparatus according to claim 8, wherein each electricity-heat converting element comprises a heat-generating resistor layer and an electrode.

13. A recording apparatus according to claim 8, wherein said semiconductor substrate of said recording head further comprises a plurality of transistor groups, each transistor group including at least one of said plurality of transistors, and each transistor group being provided with a common collector region.

14. In a liquid jet recording head:

a discharge opening for discharging a liquid from said head;

means for defining a liquid channel in said head in communication with said discharge opening; and electricity-heat converting elements provided on or in a substrate in said head and disposed proximate to said discharge opening, the substrate including a transistor array having a plurality of transistors each of which includes an emitter region which is electrically connected to a corresponding one of said electricity-heat converting elements for driving the electricity-heat converting elements independently, wherein each of the plurality of transistors includes, in addition to said emitter region, a base region and a collector region, wherein the collector region is provided in common to the plurality of transistors and surrounds the base region and the emitter region of each transistor, the collector regions, the base regions and the emitter regions comprising a semiconductor.

15. A liquid jet recording head according to claim 14, wherein a collector electrode pattern in each of the transistors is made common in the transistor array.

16. The liquid jet recording head according to claim 14, wherein said substrate comprises a semiconductor substrate.

17. The liquid jet recording head according to claim 16, wherein the semiconductor substrate is made of silicon.

18. A liquid jet recording head according to claim 14, wherein said electricity-heat converting elements are formed on said substrate.

19. A liquid jet recording head according to claim 14, wherein said electricity-heat converting element comprises a heat-generating resistor layer and an electrode.

20. A liquid jet recording head according to claim 14, wherein said substrate further includes a plurality of transistor arrays, each transistor array including at least one of said plurality of transistors and each transistor array being provided with a common collector region.

21. A substrate for a liquid jet recording head comprising:

a plurality of electricity-heat converting elements for generating heat energy for discharging a liquid; and a transistor array for driving said electricity-heat converting elements, said transistor array having a plurality of transistors, each being electrically connected to a corresponding one of said electricity-heat converting elements for individually driving said electricity-heat converting elements, each of the plurality of transistors including a base region, an emitter region and a collector region, each emitter region being electrically connected to a corresponding one of said electricity-heat converting elements, and the collector region being provided common to the plurality of transistors and surrounding the base region and the emitter region of each transistor, the collector regions, the base regions and the emitter regions comprising a semiconductor.

22. The substrate for the liquid jet recording head according to claim 21, wherein said substrate is made of semiconductor material.

23. The substrate for the liquid jet recording head according to claim 22, wherein the semiconductor material is silicon.

24. A substrate for liquid jet recording head according to claim 21, wherein said electricity-heat converting elements are formed on said substrate.

25. A substrate for liquid jet recording head according to claim 21, wherein each electricity-heat converting element comprises a heat-generating resistor layer and an electrode.

26. A substrate according to claim 21, further comprising a plurality of transistor arrays, each transistor array including a plurality of transistors and each transistor array being provided with a common collector region.

27. In a recording head cartridge:

discharge openings for discharging a liquid from said head a substrate in said head which includes electricity-heat converting elements for generating heat energy for discharging the liquid through said discharge openings, and a plurality of transistors for individually driving the electricity-heat converting elements, each of the plurality of transistors being electrically connected to a corresponding one of said electricity-heat converting elements, each of the plurality of transistors including a base region, an emitter region and a collector region, each emitter region being electrically connected to a corresponding one of said electricity-heat converting elements, and the collector region being provided in common to the plurality of transistors and surrounding the base region and the emitter region of each transistor, the collector regions, the base regions and the emitter regions comprising a semiconductor;

a storing portion for storing the liquid supplied to said recording head; and an electric contact for supplying electric signals to said transistors.

28. A head cartridge according to claim 27, wherein said electricity-heat converting elements are formed on said semiconductor substrate.

29. A head cartridge according to claims 27, wherein each electricity-heat converting element comprises a heat-generating resistor layer and an electrode.

30. A head cartridge according to claim 27, wherein said semiconductor substrate of said recording head further includes a plurality of transistor groups, each transistor group including at least one of said plurality of transistors and each transistor group being provided with a common collector region.

31. A substrate for a liquid jet printing head comprising:

a plurality of electricity-heat converting elements for generating heat energy for discharging a liquid; and an element array for supplying driving signals to said electricity-heat converting elements, said element array including a plurality of transistors, each being electrically connected to a corresponding one of said electricity-heat converting elements for individually driving said electricity-heat converting elements, each of the plurality of transistors including a first electrode region, a second electrode region and a third electrode region, the third electrode region being provided common to the plurality of transistors and surrounding the first electrode region and the second electrode region of each transistor and one of the first electrode region and the second electrode region being electrically connected to a corresponding one of said electricity-heat converting elements, each of said electrode regions comprising a semiconductor.

32. A substrate for a liquid jet printing head according to claim 31, wherein said substrate is made of semiconductor material.

33. A substrate for a liquid jet printing head according to claim 32, wherein the semiconductor material is silicon.

34. A substrate for a liquid jet printing head according to claim 31, wherein said electricity-heat converting elements are formed on said substrate.

35. A substrate for a liquid jet printing head according to claim 31, wherein each electricity-heat converting element comprises a heat-generating resistor layer and an electrode.

36. A substrate according to claim 31, further comprising a plurality of element arrays, each element array including a plurality of elements and each array being provided with a common electrode region.

37. In a liquid jet recording head comprising:

a discharge opening for discharging a liquid from said head;

means for defining a liquid channel in said head; and a substrate in said head and including a plurality of electricity-heat converting elements for generating heat energy for discharging the liquid, said substrate including an element array, and element array including a plurality of transistors each being electrically connected to a corresponding one of the electricity-heat converting elements for individually driving the electricity-heat converting elements, each of said plurality of transistors including a first electrode region, a second electrode region and a third electrode region, and the third electrode region being provided in common to the plurality of transistors and surrounding the first electrode region and the second electrode region of each transistor and one of the first electrode region and the second electrode region being electrically connected to a corresponding one of said electricity-heat converting elements, each of said electrode regions comprising a semiconductor.

38. A liquid jet printing head according to claim 37, wherein an electrode pattern in each of said plurality of elements is made common in said element array.

39. A liquid jet printing head according to claim 37, wherein said substrate comprises a semiconductor substrate.

40. A liquid jet printing head according to claim 39, wherein said semiconductor substrate is made of silicon.

41. A liquid jet printing recording head according to claim 37, wherein said electricity-heat converting elements are formed on said substrate.

42. A liquid jet printing head according to claim 37, wherein said electricity-heat converting element comprises a heat-generating resistor layer and a converting element electrode.

43. A liquid jet printing head according to claim 37, wherein said substrate further includes a plurality of element arrays, each element array including at least one of said plurality of elements and each element array being provided with a common electrode region.

44. A printing apparatus comprising:

a liquid jet printing head formed with discharging openings for discharging a liquid, and having a substrate which includes a plurality of electricity-heat converting elements for generating heat energy for discharging the liquid, and including an element array for supplying driving signals to the electricity-heat converting elements, the element array including a plurality of transistors each of which is electrically connected to a corresponding one of said electricity-heat converting elements for individually driving the electricity-heat converting elements, each of the plurality of transistors including a first electrode region, a second electrode region and a third electrode region, and the third electrode region being provided in common to the plurality of transistors and surrounding the first electrode region and the second electrode region of each transistor and one of the first electrode region and the second electrode region being electrically connected to a corresponding one of said electricity-heat converting elements, each of said electrode regions comprising a semiconductor.

45. A printing apparatus according to claim 44, further comprising a capping means for capping said discharge openings.

46. A printing apparatus according to claim 44, further comprising a suction pump for sucking the liquid within said recording head through said discharge openings.

47. A printing apparatus according to claim 44, wherein said electricity-heat converting elements are formed on said semiconductor layer.

48. A printing apparatus according to claim 44, wherein each electricity-heat converting element comprises a heat-generating resistor layer and a converting element electrode.

49. A printing apparatus according to claim 44, wherein said semiconductor layer of said recording head further comprises a plurality of element groups, each element group including at least one of said plurality of elements, and each element group being provided with a common electrode region.

* * * * *

UNITED STATES PATENT AND TRADEMARK OFFICE

CERTIFICATE OF CORRECTION

PATENT NO. : 5,774,147

DATED : June 30, 1998

INVENTOR(S) : ASAO SAITO, ET AL.

It is certified that error appears in the above-identified patent and that said Letters Patent is hereby corrected as shown below:

TITLE PAGE ITEM,

[54] "SUBSTRATE HAVING A COMMON COLLECTOR REGION AND BEING USABLE IN A LIQUID JET RECORDING HEAD" should read --LIQUID JET RECORDING HEAD WITH SUBSTRATE HAVING A COMMON COLLECTOR REGION AND BEING USABLE IN A LIQUID JET RECORDING HEAD--

DRAWINGS

SHEET 3 of 9, FIG. 3, "314 PROTECTVE" should read --314 PROTECTIVE-- and "ELECRODE" should read --ELECTRODE--.

COLUMN 1

Line 21, "recording" should read --recording by--;
Line 24, "equipments" should read --equipment--.
Line 30, "employing" should read --employing a--.

UNITED STATES PATENT AND TRADEMARK OFFICE

CERTIFICATE OF CORRECTION

PATENT NO. : 5,774,147

DATED : June 30, 1998

INVENTOR(S) : ASAO SAITO, ET AL.

It is certified that error appears in the above-identified patent and that said Letters Patent is hereby corrected as shown below:

COLUMN 2

Line 25, "which realizes" should be deleted;
Line 27, "in" should be deleted;
Line 29, "and" should read --and by--;
Line 37, "wherein said" should be deleted;
Line 38, "which are" should be deleted;
Line 39, "provided" should be deleted;
Line 43, "preferably" should read --preferably,--
Line 44, "provides," should read --provides--

COLUMN 3

Line 6, "straging" should read --storing--;
Line 9, "head 1," should read --head,--;
Line 48, "FIG. 5" should read --FIGS. 5A and 5B--; "a" should be deleted; and "view" should read "views";
Line 53, "FIG. 5" should read --FIGS. 5A and 5B--;
Line 56, "FIG. 5" should read --FIGS. 5A and 5B--.

COLUMN 4

Line 8, "$n^{30}$" should read --$n^{+}$--;
Line 47, "occurring such problems" should read -- such problems occurring--;
Line 66, "and-319" should read --and 319--.

UNITED STATES PATENT AND TRADEMARK OFFICE

CERTIFICATE OF CORRECTION

PATENT NO. : 5,774,147

DATED : June 30, 1998

INVENTOR(S) : ASAO SAITO, ET AL.

It is certified that error appears in the above-identified patent and that said Letters Patent is hereby corrected as shown below:

COLUMN 5

Line 37, "impurity" shoudl read --impurity is--;
Line 41, "steps (6)(7) and" should read --steps(6) and (7),--;
Line 50, "$SiO_2$," should read --$SiO_2$--;
Line 52, "FIG. 5" should read --FIGS. 5A and 5B--;
Line 53, "FIG. 5" should read --FIGS. 5A and 5B--;
Line 54, "a top view" should read --top views--;
Line 56, "an arrow A in FIG. 5." should read --dashed line arrows in FIG. 5B.--

COLUMN 6

Line 6, "FIG. 5" should read --FIGS. 5A and 5B--;
Line 10, "FIG. 5" should read --FIGS. 5A and 5B--;
Line 26, "Referring" should read --Referring to--.

COLUMN 7

Line 7, "about" should be deleted;
Line 30, "elements compress" should read --element comprises--.

COLUMN 9

Line 35, "for" should read --for the--;
Line 38, "for" should read --for the--;
Line 47, "head a" should read --head, a--.

UNITED STATES PATENT AND TRADEMARK OFFICE

CERTIFICATE OF CORRECTION

PATENT NO. : 5,774,147

DATED : June 30, 1998

INVENTOR(S) : ASAO SAITO, ET AL.

It is certified that error appears in the above-identified patent and that said Letters Patent is hereby corrected as shown below:

COLUMN 10

Line 4, "claims 27," should read --claim 27,--;
Line 55, "and" should read --said--.

COLUMN 11

Line 10, "recording" should be deleted

Signed and Sealed this

Fourteenth Day of September, 1999

*Attest:*

Q. TODD DICKINSON

*Attesting Officer*

*Acting Commissioner of Patents and Trademarks*